US010240224B2

(12) United States Patent
Enloe et al.

(10) Patent No.: US 10,240,224 B2
(45) Date of Patent: Mar. 26, 2019

(54) STEEL ALLOY WITH TAILORED HARDENABILITY

(71) Applicant: GM Global Technology Operations LLC, Detroit, MI (US)

(72) Inventors: Charles M. Enloe, Grosse Pointe Woods, MI (US); Jianfeng Wang, Jiangsu (CN); Curt D. Horvath, Plymouth, MI (US); Jatinder P. Singh, Troy, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 221 days.

(21) Appl. No.: 15/235,922

(22) Filed: Aug. 12, 2016

(65) Prior Publication Data

US 2018/0044769 A1 Feb. 15, 2018

(51) Int. Cl.

| | |
|---|---|
| ***C22C 38/02*** | (2006.01) |
| ***C22C 38/04*** | (2006.01) |
| ***C22C 38/22*** | (2006.01) |
| ***C22C 38/26*** | (2006.01) |

(52) U.S. Cl.

CPC ..... *C22C 38/26* (2013.01); *C22C 38/02* (2013.01); *C22C 38/04* (2013.01); *C22C 38/22* (2013.01); *C21D 2211/002* (2013.01); *C21D 2211/005* (2013.01); *C21D 2211/008* (2013.01); *C21D 2211/009* (2013.01)

(58) Field of Classification Search

CPC ..... C22C 38/02; C22C 38/04; C22C 38/18; C22C 38/22; C22C 38/26; C22C 38/12; C22C 2211/002; C22C 2211/005; C22C 2211/008; C22C 2211/009

See application file for complete search history.

(56) References Cited

U.S. PATENT DOCUMENTS

| | | | | |
|---|---|---|---|---|
| 5,403,410 | A * | 4/1995 | Shikanai | C22C 38/14 148/328 |
| 8,252,125 | B2 | 8/2012 | Giefers et al. | |
| 8,778,261 | B2 | 7/2014 | Nakamura et al. | |
| 8,932,416 | B2 | 1/2015 | Nakanishi et al. | |
| 8,992,697 | B2 | 3/2015 | Matsuda et al. | |
| 9,359,663 | B2 | 6/2016 | Mizuta et al. | |
| 9,475,113 | B2 | 10/2016 | Naitou et al. | |
| 9,512,499 | B2 | 12/2016 | Tomokiyo et al. | |
| 9,593,392 | B2 | 3/2017 | John et al. | |
| 9,598,745 | B2 | 3/2017 | Hayashi et al. | |
| 9,605,329 | B2 | 3/2017 | Nonaka et al. | |
| 9,611,518 | B2 | 4/2017 | Naitou et al. | |
| 9,617,624 | B2 | 4/2017 | Tanahashi et al. | |
| 9,644,247 | B2 | 5/2017 | Matsuda et al. | |
| 9,725,782 | B2 | 8/2017 | Nonaka et al. | |
| 9,840,751 | B2 | 12/2017 | Hayashi et al. | |

(Continued)

FOREIGN PATENT DOCUMENTS

| | | | |
|---|---|---|---|
| DE | 69613868 | T2 | 11/2001 |
| DE | 112005003112 | T5 | 4/2008 |

*Primary Examiner* — C Melissa Koslow

(57) ABSTRACT

An alloy with tailored hardenability includes carbon, silicon, manganese, nickel, molybdenum, chromium, vanadium, and cobalt. A time and temperature transformation diagram of the alloy has a bainite nose and a ferrite nose that occur at approximately the same time at approximately 4 seconds at temperatures of about 750 K and 950 K, respectively.

7 Claims, 3 Drawing Sheets

(56) References Cited

U.S. PATENT DOCUMENTS

| | | | |
|---|---|---|---|
| 9,850,554 | B2 | 12/2017 | Naitou et al. |
| 9,896,736 | B2 | 2/2018 | Tomokiyo et al. |
| 9,920,407 | B2 | 3/2018 | Nonaka et al. |
| 9,945,013 | B2 | 4/2018 | Nonaka et al. |
| 10,029,294 | B2 | 7/2018 | Yamano et al. |
| 10,030,280 | B2 | 7/2018 | Hayashi et al. |
| 10,072,324 | B2 | 9/2018 | Nonaka et al. |
| 2002/0153070 | A1 | 10/2002 | Toyooka et al. |

* cited by examiner

STEEL ALLOY WITH TAILORED HARDENABILITY

FIELD

The present disclosure relates to a steel alloy. More specifically, the present disclosure relates to a steel alloy with tailored hardenability.

BACKGROUND

The statements in this section merely provide background information related to the present disclosure and may not constitute prior art.

The standard alloy employed in press hardened steel processing has existed for many years. This alloy composition was initially developed for long product induction heat treatment. Tailored blanks and tailored property processing, however, are increasingly being employed in, for example, automotive body structure designs to provide lighter weight structures with enhanced impact performance. Examples of tailored structural component technology include tailored blanks, tailored tempering of press hardened steels, and tailored austenitizing and quenching of press hardened steels. Since the aforementioned alloy composition was not developed for use in tailored property processes, there is a need in the art for such an alloy composition.

SUMMARY

The present invention provides an alloy with tailored hardenability. In one aspect, the alloy includes carbon, silicon or niobium, manganese, molybdenum, chromium, and trace elements present and varying from steelmaking practices. A time and temperature transformation diagram of the alloy has a bainite nose and a ferrite nose that occur at approximately the same time at temperatures of approximately 750 K and 950 K, respectively.

The foregoing aspect of the present invention can be further characterized by one or any combination of the features described herein, such as: boron is absent from the alloy; the bainite nose and the ferrite nose occur at about four seconds; the silicon is present in an amount of about 0.6% by weight; the carbon is present in an amount of about 0.2% by weight, the silicon is present in an amount of about 0.6% by weight, the manganese is present in an amount of about 1.2% by weight, the molybdenum is present in an amount of about 0.1% by weight, the chromium is present in an amount of about 0.4% by weight; the niobium is present in an amount of about 0.6% by weight; the alloy has an austenitizing temperature of about 1123 K to 1223 K; the alloy has a hardness of about 450-500 HV as martensite, 400-500 HV as a combination of martensite and bainite, 240-400 HV as a combination of ferrite, bainite and martensite, and less than 200 HV as a combination of ferrite, pearlite, and bainite; the alloy has a modulus of elasticity typical of press hardened steel of about 200 GPa; and the alloy has a tensile strength of about 1400-1550 MPa as martensite, 1300-1500 MPa as a combination of martensite and bainite, 1000-1300 MPa as a combination of ferrite, bainite and martensite, and less than 1000 MPa as a combination of ferrite, pearlite, and bainite.

In another aspect, a machine component with tailored hardenability includes an alloy with carbon, silicon or niobium, manganese, molybdenum, and chromium. A time and temperature transformation diagram of the alloy has a bainite nose and a ferrite nose that occur at approximately the same time at temperatures of approximately 750 K and 950 K, respectively.

The foregoing aspect of the present invention can be further characterized by one or any combination of the features described herein, such as: boron is absent from the alloy; the bainite nose and the ferrite nose occur at about four seconds; the carbon is present in an amount of about 0.2% by weight, the silicon or niobium is present in an amount of about 0.6% by weight, the manganese is present in an amount of about 1.2% by weight, the molybdenum is present in an amount of about 0.1% by weight, the chromium is present in an amount of about 0.4% by weight; the carbon is present in an amount of about 0.2% by weight, the manganese is present in an amount of about 1.2% by weight, the molybdenum is present in an amount of about 0.1% by weight, the chromium is present in an amount of about 0.4% by weight; over a region of about one cm of the machine component, quenching of the alloy varies from about 2 K per second to about 50 K per second; and the alloy has an austenitizing temperature of about 1123 K to about 1223 K.

Further features, advantages, and areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way. The components in the figures are not necessarily to scale, emphasis instead being placed upon illustrating the principles of the invention. In the drawings.

DETAILED DESCRIPTION

The following description is merely exemplary in nature and is not intended to limit the present disclosure, application, or uses.

Figure 1:
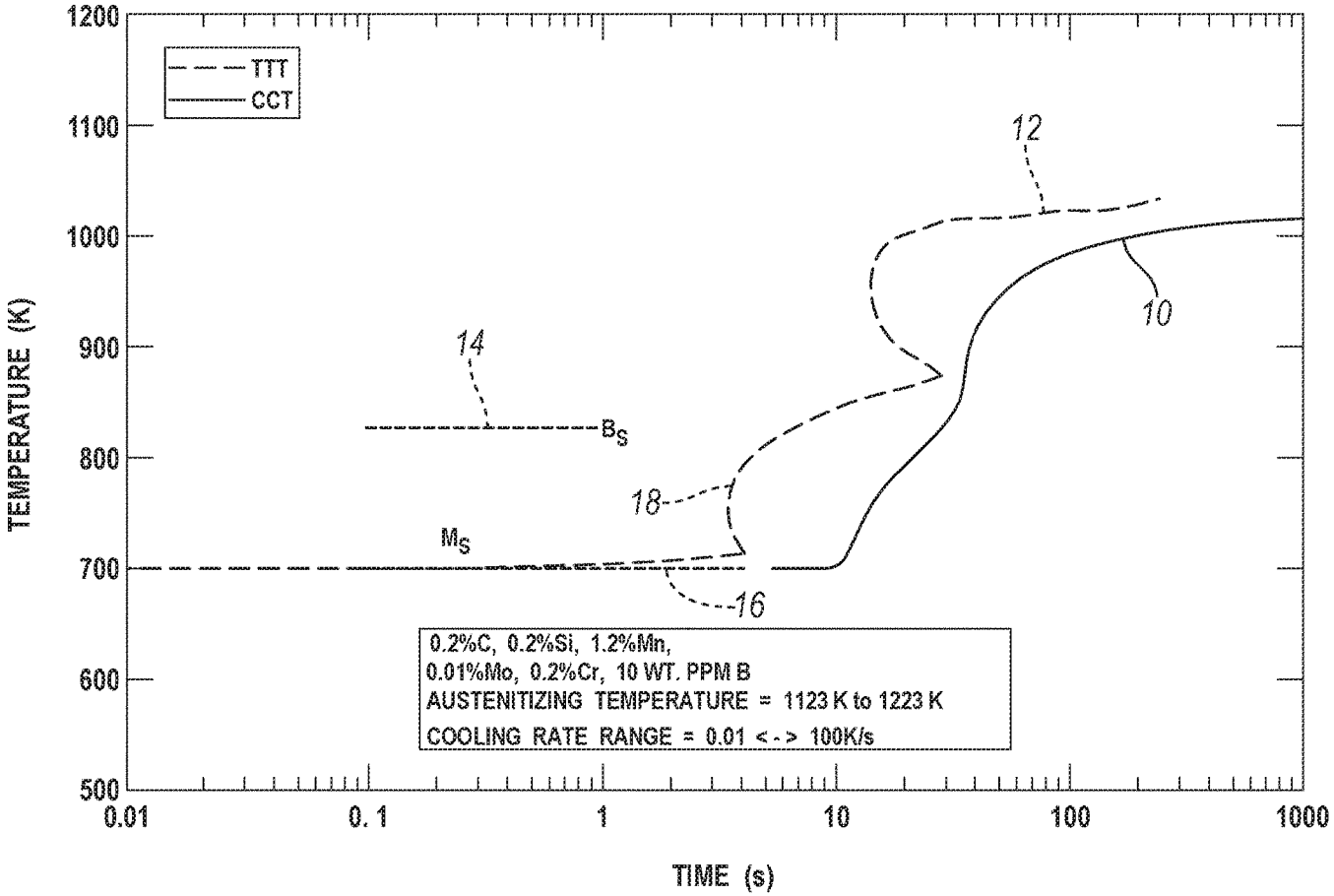
(PRIOR ART) FIG. 1
FIG. 1 is a time/temperature transformation diagram for a steel alloy.

Referring now to the drawings, FIG. 1 illustrates a time/temperature transformation diagram for a standard steel alloy, such as, 22MnB5, used for press hardened steel (PHS) processing. The diagram shows both a continuous cooling profile 10 and an isothermal hold profile 12. For this particular alloy, the bainite start temperature 14 occurs at about 820 K, and the martensite start temperature 16 occurs at about 700 K. As the isothermal hold profile 12 indicates, the alloy has a bainite nose 18 that occurs at about 3 seconds and a ferrite nose that occurs at about 11 seconds.

Figure 2:
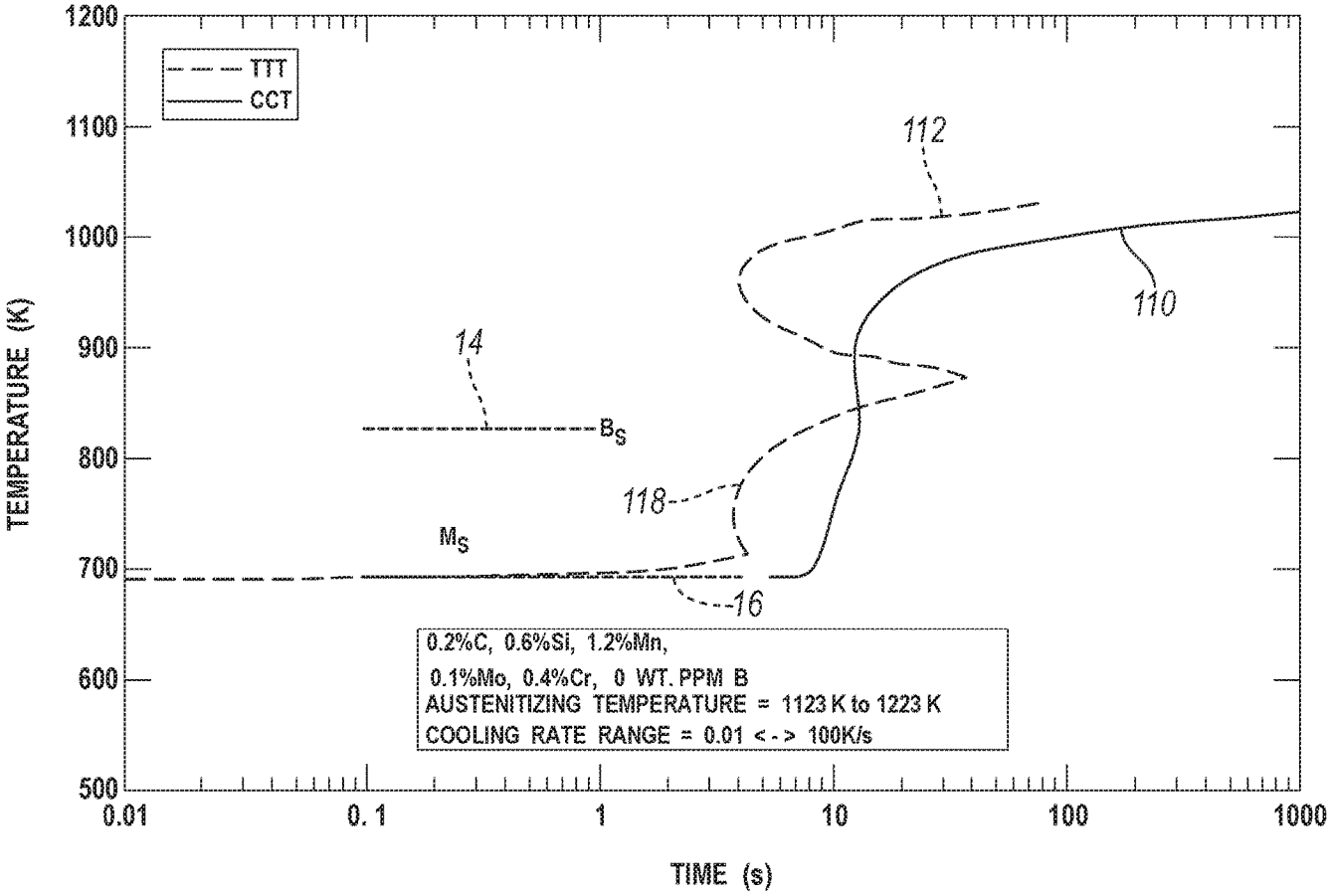
FIG. 2 is a time/temperature transformation diagram for a steel alloy in accordance with the principles of the present invention.

Turning now to FIG. 2, there is shown a time/temperature transformation diagram for a modified alloy with tailored hardenability in accordance with the principles of the present invention. While the alloy in FIG. 1 includes boron, boron is absent in the alloy in FIG. 2. Unlike the alloy composition illustrated in FIG. 1, the alloy in FIG. 2. As for the composition of the alloy, carbon is present in an amount of about 0.2% by weight, silicon is present in an amount of about 0.6% by weight, manganese is present in an amount of about 1.2% by weight, molybdenum is present in an amount of about 0.1% by weight, and chromium is present in an amount of about 0.4% by weight.

In an alternative modified alloy, in accordance with the principles of the present invention, silicon is replaced with niobium. Hence, in the alternative alloy composition, carbon is present in an amount of about 0.2% by weight, niobium is present in an amount of about 0.6% by weight, manganese is present in an amount of about 1.2% by weight, molybdenum is present in an amount of about 0.1% by weight, and chromium is present in an amount of about 0.4% by weight.

Referring back to FIG. 2, the alloy composition provides a bainite start temperature 14 that occurs at about 820 K and martensite start temperature 16 that occurs also at about 700 K since the carbon content remains the same. Moreover, the austinitizing temperate for the modified alloy is about 1123 K to 1223 K.

Figure 3:
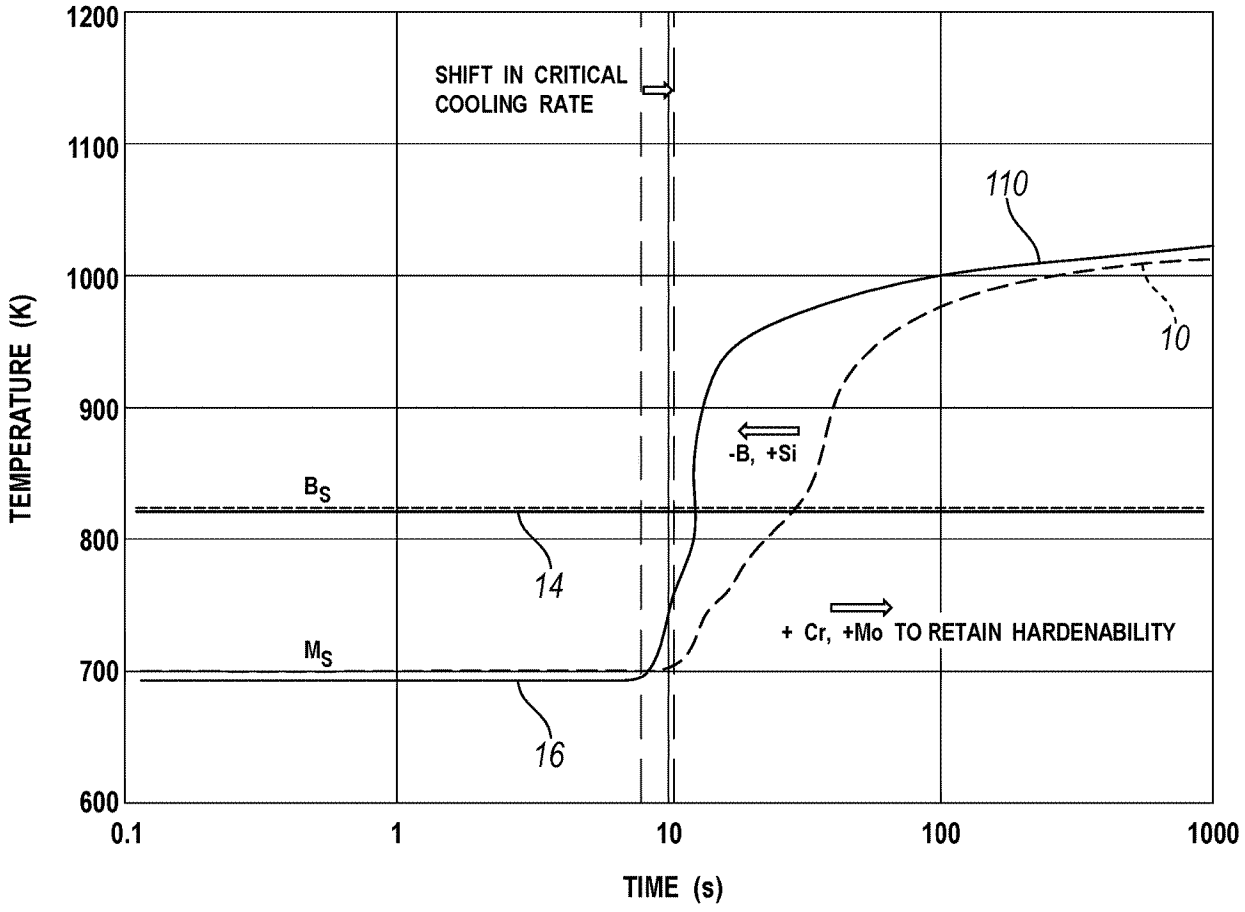
FIG. 3 is a time/temperature transformation diagram of the continuous cooling profiles shown in FIGS. 1 and 2.

FIG. 2 further indicates that for this alloy composition the bainite nose 118 along an isothermal hold profile 112 has shifted to about 4 seconds and the ferrite nose 120 has shift to about 4 seconds as well. Referring also to FIG. 3, the alloy composition featured in FIG. 2 produces a continuous cooling profile 110 that is steeper than the continuous cooling profile 10 of the standard alloy and only a shift in the critical cooling rate when boron is not added to the composition and the relative amount of silicon is increased, which promotes the production of ferrite (not bainite) at a lower cooling rate. The ability to cool the alloy slowly enables producing a softer component made of the alloy. While the removal of boron reduces the hardenability of the alloy, the addition of silicon increases the hardenability somewhat but favors the production of ferrite as non-martensitic product relative to bainite. Note also that the amount of molybdenum has been increased from 0.01% to about 0.1% by weight and the chromium has been increased from 0.2% to about 0.4% by weight to retain hardenability in the modified alloy composition featured in FIG. 2.

The modified alloy featured in FIG. 2 enables tailored hardenability. In particular, the alloy utilizes physical metallurgical principles of steel hardenability to tailor austenite decomposition response during cooling by modifying the silicon, chromium, molybdenum and boron content. The modified alloy of FIG. 2 provides a sharper and more repeatable strength/hardness profiles during a transition from fast to slow quenching, for example, in a press hardening operation.

Use of the modified alloy (FIG. 2), enables greater use of ultra-high strength press hardened steels (tensile strength >1,300 MPa) with tailored crush/impact performances, which, in turn, enables greater design flexibility and weight reduction of, for example, motor vehicle structures. The modified alloy further enables use of PHS processing by reducing variability in part performance due to process variability. And by reducing process/product variabilities, the use of the modified alloy reduces production costs by reducing or eliminating the necessity for laser welded blanks and/or post tempering processes (such as, laser or die process) for tailored structures. Hence, the use of the modified alloy allows for a processing strategy that places the desired properties in the desired places. For example, the use of the modified alloy enables tailored hardness/strength over a region of about one cm of a machine component since the quenching of the modified alloy can be varied from about 2 K per second to about 50 K per second over the one cm region. Hence, the alloy enables a more abrupt transition in hardness for a given thermal profile gradient in, for example, hot stamping tooling. Thus, for the production of a motor vehicle frames, the modified alloy enables producing regions of the frame with high strength and other regions of the frame with higher ductility for more energy absorption with the use of a single die with multiple cooling rates. In various arrangements, the modified alloy has a hardness of about 450-500 HV as martensite, 400-500 HV as a combination of martensite and bainite, 240-400 HV as a combination of ferrite, bainite and martensite, and less than 200 HV as a combination of ferrite, pearlite, and bainite; the alloy has a modulus of elasticity typical of press hardened steel of about 200 GPa; and the alloy has a tensile strength of about 1400-1550 MPa as martensite, 1300-1500 MPa as a combination of martensite and bainite, 1000-1300 MPa as a combination of ferrite, bainite and martensite, and less than 1000 MPa as a combination of ferrite, pearlite, and bainite.

The description of the invention is merely exemplary in nature and variations that do not depart from the gist of the invention are intended to be within the scope of the invention. Such variations are not to be regarded as a departure from the spirit and scope of the invention.

What is claimed is:

1. A steel alloy with tailored hardenability comprising in % by weight:

0.2% carbon;

either 0.6% silicon or 0.6% niobium;

1.2% manganese;

0.1% molybdenum; and 0.4% chromium, and wherein boron is absent from the alloy, and wherein a time and temperature transformation diagram of the alloy has a bainite nose and a ferrite nose that occur at approximately the same time for temperatures of approximately 750K and 950K.

2. The alloy of claim 1 wherein the bainite nose and the ferrite nose occur at about four seconds.

3. The alloy of claim 1 wherein the alloy has an austenitizing temperature of about 1123 K to 1223 K.

4. The alloy of claim 1 wherein the alloy has a hardness of about 450-500 HV as martensite, 400-500 HV as a combination of martensite and bainite, 240-400 HV as a combination of ferrite, bainite and martensite, and less than 200 HV as a combination of ferrite, pearlite, and bainite.

5. The alloy of claim 1 wherein the alloy has a modulus of elasticity typical of press hardened steel of about 200 GPa.

6. The alloy of claim 1 wherein the alloy has a tensile strength of about the alloy has a tensile strength of about 1400-1550 MPa as martensite, 1300-1500 MPa as a combination of martensite and bainite, 1000-1300 MPa as a combination of ferrite, bainite and martensite, and less than 1000 MPa as a combination of ferrite, pearlite, and bainite.

7. The alloy of claim 1 wherein over a region of about one cm of a machine component made of the alloy, quenching of the alloy varies from about 2° K per second to about 50° K per second.

* * * * *